US006102458A

United States Patent [19]

Scace

[11] Patent Number: 6,102,458

[45] Date of Patent: Aug. 15, 2000

[54] DETACHABLE HANDLE FOR CONTAINERS

[75] Inventor: Stuart A. Scace, Pittsfield, Mass.

[73] Assignee: Stuart Allyn Company, Inc., Pittsfield, Mass.

[21] Appl. No.: 09/304,174

[22] Filed: May 3, 1999

[51] Int. Cl.[7] ..... B65D 25/28

[52] U.S. Cl. ..... 294/34; 220/759

[58] Field of Search ..... 294/27.1, 29, 32, 294/34; 220/696, 741, 742, 752, 757, 759, 764, 769; 248/311.2, 312.1, 210

[56] References Cited

U.S. PATENT DOCUMENTS

| | | | |
|---|---|---|---|
| D. 372,844 | 8/1996 | Nunes | D7/622 |
| 2,010,317 | 8/1935 | Olson | 220/94 |
| 2,262,339 | 11/1941 | Shaffer | 220/769 |
| 2,305,492 | 12/1942 | Poglein | 294/27 |
| 2,396,479 | 3/1946 | Votaw | 294/34 |
| 2,426,682 | 9/1947 | Hallstream | 294/34 |
| 2,613,860 | 10/1952 | Hoffman | 224/45 |
| 2,709,540 | 5/1955 | Kenney | 220/696 |
| 2,786,707 | 3/1957 | Campbell | 220/759 |
| 2,788,153 | 4/1957 | Broadbelt | 220/90 |
| 2,808,285 | 10/1957 | Robuck | 294/29 |
| 2,838,202 | 6/1958 | Huether | 220/759 |
| 2,905,500 | 9/1959 | Thombs | 294/34 |
| 3,024,057 | 3/1962 | Lockwood | 294/34 |
| 3,076,223 | 2/1963 | Reichold | 16/114 |
| 3,305,261 | 2/1967 | Swanke | 220/759 |
| 3,979,011 | 9/1976 | Schleicher | 220/94 |
| 4,053,131 | 10/1977 | Francis | 248/211 |
| 4,609,200 | 9/1986 | Winter | 294/27.1 |
| 4,919,298 | 4/1990 | Gregory | 220/759 |
| 4,993,767 | 2/1991 | Song | 294/31.1 |
| 5,482,339 | 1/1996 | Chishko, Jr. | 294/27.1 |
| 5,584,520 | 12/1996 | Niemeier | 294/34 |

FOREIGN PATENT DOCUMENTS

| | | | |
|---|---|---|---|
| 711169 | 6/1954 | United Kingdom | 294/32 |
| 1221764 | 2/1971 | United Kingdom | 294/34 |

*Primary Examiner*—Dean J. Kramer
*Attorney, Agent, or Firm*—Heslin & Rothenberg, P.C.

[57] ABSTRACT

A detachable handle is disclosed which is readily fixed in size for securely attaching to a standard sized container, and desirably, readily fixed in a plurality of different configurations for securely attaching to a plurality of different standard sized containers, e.g., a pint-sized paint can and a quart-sized paint can. The detachable handle includes a first member comprising a handle, a generally vertically extending first leg, and a first container engaging portion. A second member includes a generally vertically extending second leg and a second container engaging portion. Each leg includes an aperture extending generally horizontally therethrough. The container engaging portions are engageable with the top rim and the bottom rim, respectively, of the standard sized container so that the apertures align and through which a screw is insertable to slidably engage portions of the legs defining the apertures to inhibit disengagement of the container engaging portions from the standard sized container.

16 Claims, 3 Drawing Sheets

DETACHABLE HANDLE FOR CONTAINERS

FIELD OF THE INVENTION

The present invention relates generally to detachable handles for containers. More particularly, the present invention relates to detachable handles which attach to a top rim and a bottom rim of a standard sized container.

BACKGROUND INFORMATION

Conventional gallon-size paint cans are provided with a wire handle attached at the ends thereof to the side of the paint can for use in holding the paint can and for pouring paint from the paint can. Conventional paint cans such as pint-sized and quart-sized paint cans are typically sold without handles.

Various types of detachable handles have been provided which releasably attach to a paint can for carrying the paint can and for pouring paint from the paint can.

For example, U.S. Pat. No. 2,905,500 to Thombs discloses a detachable handle adapted for use with a paint can. The detachable handle includes a frame having a jaw member which engages a bottom rim of the paint can, and a movable jaw member which releasably attaches to the frame and engages a top rim of the paint can. The movable jaw member and the frame are fixedly attached to each other with a screw and wing nut. In particular, the screw extends through vertically aligned holes in the movable jaw member and the frame.

A drawback of the detachable handle of Thombs is that, if the wing nut becomes loose, the handle will detach from the paint can. This is particularly undesirable when carrying the paint can by the detachable handle. Another drawback of the detachable handle disclosed in Thombs is that the handle is sized only for attachment to a single sized paint can.

Other detachable handles adapted for use with a paint can have been devised which are releasably attachable to various sized paint cans. For examples, U.S. Pat. No. 2,010,317 to Olson discloses a detachable handle having a fixed jaw member, a movable jaw member, and a vertically extending spring for biasing the jaw members toward each other to clampingly engage the top and bottom rims of a paint can. A drawback with the detachable handle disclosed in Olson is that the detachable handle not fixedly attached to the paint can and is susceptible to disengagement from the paint can.

Another example of a detachable handle adapted for attaching to various sized paint cans is U.S. Pat. No. 2,808,285 to Robuck. Robuck discloses a detachable handle having first and second jaw members, and a generally vertically extending screw-threaded member which is rotated to adjust the spacing between the jaw members to clampingly engage the top and bottom rims of a paint can.

U.S. Pat. No. 3,024,057 to Lockwood discloses a detachable handle having a pair of jaw members, one of which includes a vertically extending slot, through which a screw/wing nut assembly is used to adjust the spacing between the jaw members to clampingly engage the top and bottom rims of various sized paint cans. See also U.S. Pat. No. 2,613,860 to Hoffman and U.S. Pat. No. 5,584,520 to Niemeier.

A drawback with the above-noted detachable handles disclosed in Robuck, Lockwood, Hoffman, and Niemeier, which are adjustably attachable to various sized paint cans, is that if the rotatable screw or the screw/wing nut assembly loosens, the handle will detach from the paint can. Again, this is particularly undesirable when carrying the paint can by the detachable handle.

Therefore, there is a need for a detachable handle for a container which readily and securely attaches to one or more standard sized containers such as conventional paint cans or coffee cans.

SUMMARY OF THE INVENTION

Pursuant to the present invention, the shortcomings of the prior art are overcome and additional advantages provided through the provision of a detachable handle for a standard sized container having a top rim and a bottom rim. In one embodiment, the detachable handle includes a first member comprising a handle, a generally vertically extending first leg, and a first container engaging portion. The first leg includes a first aperture extending generally horizontally through the first leg. A second member includes a generally vertically extending second leg and a second container engaging portion. The second leg includes a second aperture extending generally horizontally through the second leg. When the first and second container engaging portions are engaged with the top rim and the bottom rim, respectively, of the standard sized container, the first aperture is aligned with the second aperture so that an insertable member is insertable through the first and second apertures and slidably engageable with portions of the first and second legs defining the first and second apertures to inhibit disengagement of the first and second container engaging portions from the standard sized container.

In another aspect of the invention, the second leg of the detachable handle includes a plurality of spaced-apart apertures separately alignable with the first aperture so that the detachable handle is seperately releasably attachable to a plurality of different standard sized containers.

In still another aspect of the invention, the first aperture includes a first plurality of spaced-apart apertures, the second aperture comprises a second plurality of spaced-apart apertures, and the first and second plurality of apertures are alignable.

In yet another aspect of the invention, the detachable handle includes a third member comprising a generally vertically extending third leg and a third container engaging portion. The third leg includes a third aperture extending generally horizontally through the third leg. Desirably, the first and second members define a detachable handle attachable to a first sized container, e.g., at least one of a pint-sized paint can and a quart-sized paint can, and the first and third members define a detachable handle attachable to a second differently sized container, e.g., a gallon-sized paint can.

BRIEF DESCRIPTION OF THE DRAWINGS

These and other objects, advantages and features of the present invention will be more readily understood from the following detailed description of certain preferred embodiments of the present invention, when considered in conjunction with the accompanying drawings in which.

DETAILED DESCRIPTION OF THE PREFERRED EMBODIMENTS

Figure 1:
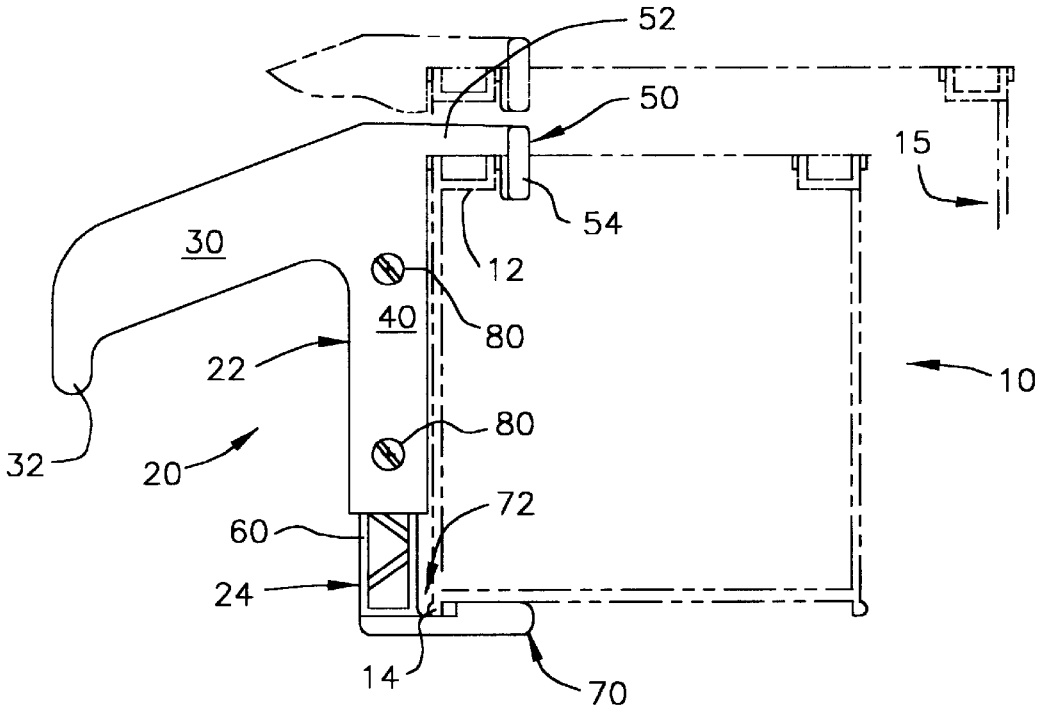
FIG. 1 is a side elevational view of one embodiment of a detachable handle of the present invention.
Figure 2:
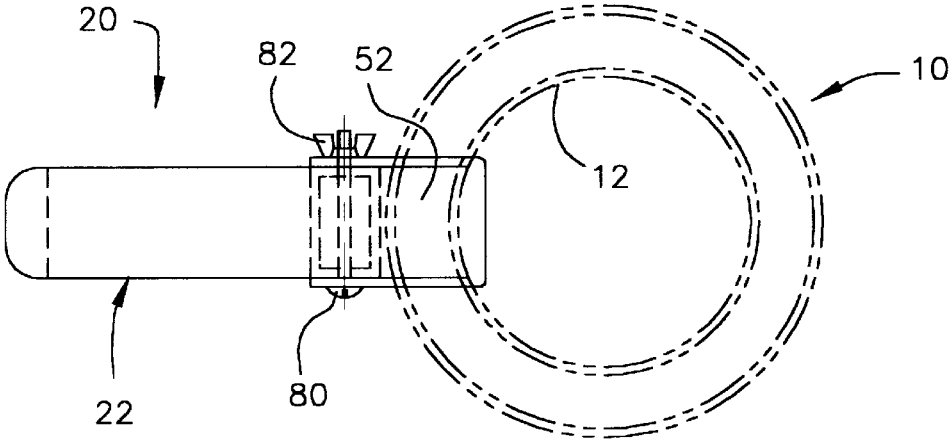
FIG. 2 is a top view of the detachable handle shown in FIG. 2.

With reference to FIGS. 1–2, therein illustrated is one embodiment of the present invention for a detachable handle. Exemplary detachable handle 20 is readily fixed in size for securely attaching to a standard sized container 10 such as a paint can. Desirably, detachable handle 20 is readily fixed in a plurality of different configurations for separately attaching to a plurality of differently standard sized containers, e.g., container 10 such as a pint-sized paint can (shown in phantom in FIG. 1) and a container 15 such as a quart-sized paint can (shown in phantom in FIG. 1).

Detachable handle 20 generally comprises a two-piece construction including a first member 22 and a second member 24 which are readily fastened together and sized for engagement and attachment to a top rim 12 and a bottom rim 14 of container 10 (or container 15).

First member 22 includes a handle 30, a generally vertically extending leg 40, and a container engaging portion 50. Handle 30 extends outwardly and downwardly at an angle from leg 40. The underside of handle 30 comprises a downwardly depending knob 32 to prevent a person's hand from slipping when holding the container or poring the contents from the container. Container engaging portion 50 includes an inwardly extending portion 52 having at the end thereof a downwardly depending tab or flange 54 to define a recess between flange 54 and leg 40 for receiving rim 12 of container 10.

Second member 24 is generally L-shaped having a generally vertically extending leg 60 and a bottom container engaging portion 70. Bottom container engaging portion 70 may include a relief or cutout 72 which is sized for receiving and engaging bottom rim or bead 14 of container 10.

In this exemplary detachable handle 20, leg 60 of second member 24 is telescopically receivable within leg 40 of first member 22. Leg 40 and leg 60 are releasably attached to each other by a pair of screws 80 and wing nuts 82 (only one of which is shown in FIG. 2).

Figure 3:
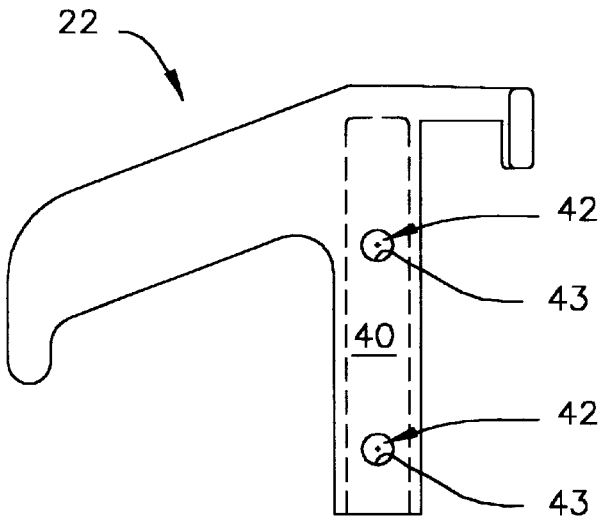
FIG. 3 is a side elevational view of the first or top portion of the detachable handle shown in FIG. 1.
Figure 4:
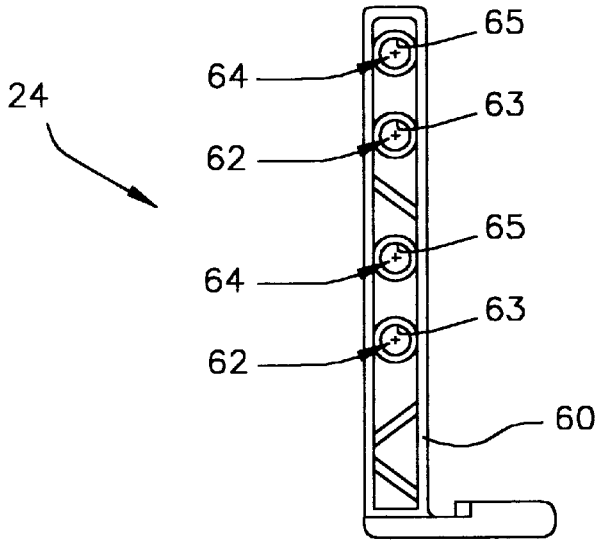
FIG. 4 is a side elevational view of the second or bottom portion of the detachable handle shown in FIG. 1.

As best shown in FIG. 3, leg 40 of first member 22 has a pair of generally horizontally disposed spaced-apart apertures or holes 42 extending therethrough, and as best shown in FIG. 4, leg 60 has two pairs of generally horizontally disposed spaced-apart apertures or holes 62 and 64 extending therethrough. Aperture 42 of leg 40 are correspondingly positioned for alignment with either of apertures 62 or 64 of leg 60.

With reference to FIGS. 1–4, to releasably attach detachable handle 20 to container 10, second member 24 is disposed so that container engaging portion 70 receives and engages bottom rim 14 of container 10. First member 22 is positioned so that leg 40 telescopically receives leg 60 of second member 24 and so that container engaging portion 50 engages top rim 12 of container 10. Upon container engaging portions 50 and 70 engaging and/or abutting top rim 12 and bottom rim 14, respectively, apertures 42 of leg 40 are aligned with apertures 62 of leg 60. For example, the apertures are disposed and extend through legs 40 and 60 so that when assembled, as discussed below, the distance between container engaging portions is sized for engaging and attaching to the standard sized container.

Each of the pair of screws 80 is respectively insertable through corresponding apertures 42 and 62, and each of the pair of wing nuts 82 is respectively threadably attachable to an end of screw 80 so that first member 22 is fixedly configured relative to second member 24.

Desirably, apertures 42 are structured and disposed through leg 40 so that the outer longitudinally extending surface of screw 80 slidably engages portions of legs 40 and 60 defining apertures 42 and 62 thereby fixing leg 40 relative to leg 60 and inhibiting disengagement of the first and second container engaging portions 50 and 70 from the standard sized container 10. For example, portions of leg 40 define stops 43 which engage and abut portion of the outer longitudinally extending surface of screw 80. Similarly, portions of leg 60 define stops 63 (and 65) which engage and abut portions of the outer longitudinally extending surface of screw 80.

From the present description, it will be appreciated by those skilled in the art that screw 80 and wing nut 82 need not be assembled and tightened so that the screw head and wing nut clampingly engage the sides of leg 40 in order to maintain detachable handle 20 securely attached to container 10. Advantageously, even if the wing nut is loosely threaded onto the screw, the detachable handle is maintained in a rigid fixed configuration and inhibited, if not prevented, from detaching from container 10. In addition, the detachable handle, and in particular, the container engaging portions thereof, need not clampingly engage the container. Desirably, the detachable container is assembled so that there is little or no play between the container engaging portions and the rims of the container when the detachable handle is attached to the container. Furthermore, a detachable handle according to the present invention may have vertically-extending legs in which each include a single generally horizontally-extending aperture for receiving a single screw. However, providing a pair of apertures, as described and illustrated, prevents leg 40 and leg 60 from pivoting about one screw and also reduces the likelihood of the detachable handle from inadvertently detaching from the container if one screw is removed.

Figure 5:
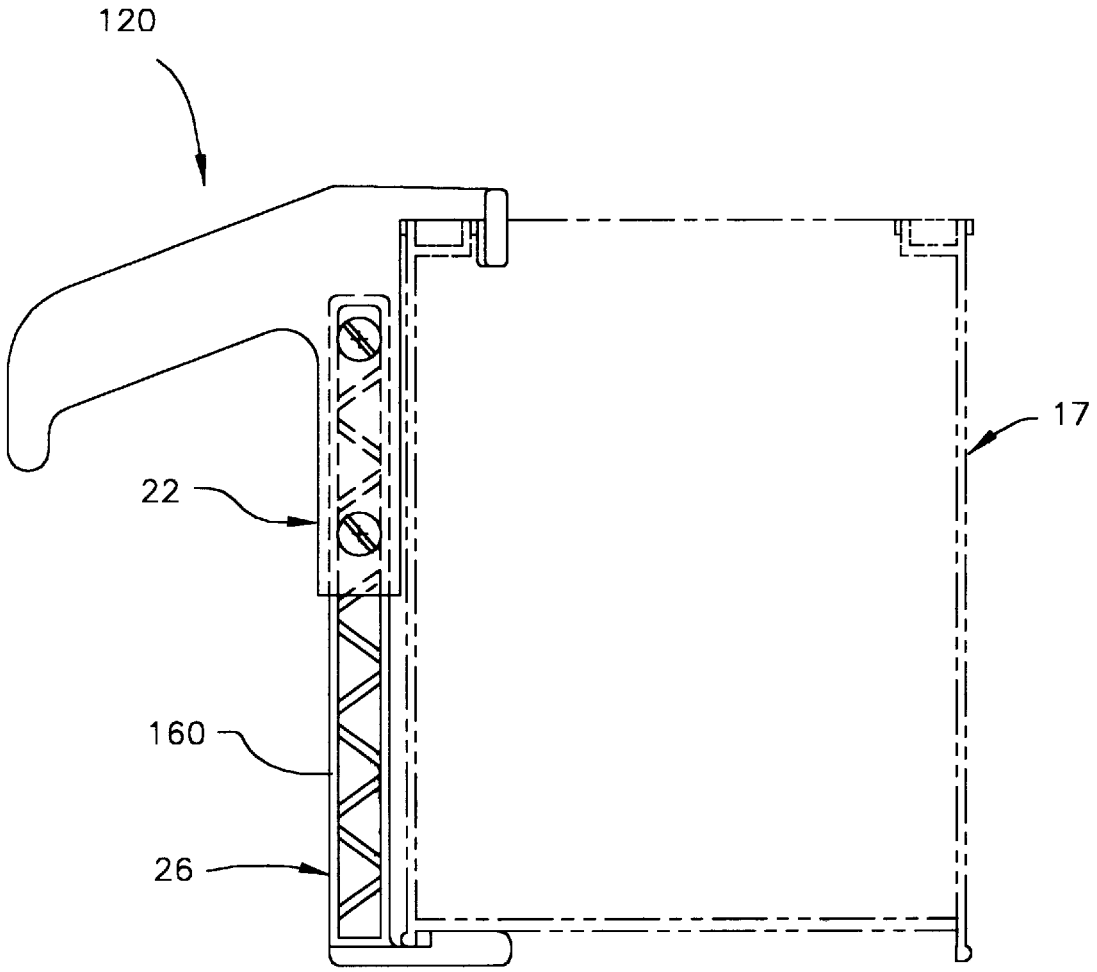
FIG. 5 is a side elevational view of another embodiment of a detachable handle of the present invention.

FIG. 5 illustrates another embodiment of the present invention for a detachable handle 120 which readily and securely attaches to a gallon-sized container 17. Detachable handle 120 includes a first member 22, as described above, and a third member 26. Third member 26 is similar to second member 24 as described above, but includes a leg 160 sized to permit detachable handle 120 to be sized for attachment to the larger gallon-sized container 17.

While the detachable handles have been described and illustrated having a screw and wing nut assembly, from the present invention it will be appreciated by those skill in the art that other suitable fasteners or fastener assemblies may be equally employed. For examples, a suitable fastener may include a pair of quick-release fasteners such as commercially available locking pins having one or more spring-loaded or push-button activated balls which inhibit or prevent removal of the pin from the apertures.

It will also be appreciated that the apertures in legs 40, 60, and 160 can have any number of suitable cross-sectional configurations. For examples, the apertures may have a circular-shaped or a square-shaped cross-sectional configuration. Desirably, the apertures comprise substantially equal and matching cross-sectional configurations. It is also possible for one of more apertures to have an elongated cross-sectional configuration, e.g., oval-shaped, so long as the portion of the leg defining the aperture provides a stop disposed adjacent to the outer surface of the fastener inserted through the aligned apertures to inhibit or prevent the first and second members (or first and third members) of the detachable handle from moving in a direction away from each other, i.e., to inhibit or prevent disengagement of the detachable handle from the container.

While the handle is described and illustrated attached to the first or top member of the detachable handle, it will be appreciated that the detachable handle can be configured so that the handle is attached to the second or bottom member.

Also, the first member may be provided with a plurality of sets of apertures which align with a single set of apertures on the second member or third member.

The detachable handle may be formed of a molded plastic material or fabricated from wood. The handle, the legs and the container engaging portions may be separately formed and assembled together, or formed as an integral unit.

From the present description, it will also be appreciated by those skilled in the art the detachable handle can be sized and configured for attachment to various standard sized containers other than those noted above, such as standard half-pound sized coffee containers, one-pound sized coffee containers, standard metric sized containers, etc.

Thus, while various embodiments of the present invention have been illustrated and described, it will be appreciated to those skilled in the art that many changes and modifications may be made thereunto without departing from the spirit and scope of the invention.

What is claimed is:

1. A detachable handle for use with a first standard sized container having a first top rim and a first bottom rim and for use with a second different standard sized container having a second top rim and a second bottom rim, said detachable handle comprising:

a first member comprising a handle, a generally vertically extending first leg, and a first container engaging portion, said first leg comprising a first aperture extending generally horizontally through said first leg;

a second member comprising a generally vertically extending second leg and a second container engaging portion, said second leg comprising a second aperture extending generally horizontally through said second leg;

a third member comprising a generally vertically extending third leg and a third container engaging portion, said third leg comprising a third aperture extending generally horizontally through said third leg; and wherein when said first and second container engaging portions are engageable with the first top rim and the first bottom rim, respectively, of the first standard sized container, said first aperture is alignable with said second aperture so that an insertable member is insertable through said first and second apertures and slidably engageable with portions of said first and second legs defining said first and second apertures to inhibit disengagement of said first and second container engaging portions from the first standard sized container; and wherein when said first and third container engaging portions are engageable with the second top rim and the second bottom rim, respectively, of the second different standard sized container, said first aperture is alignable with said third aperture so that an insertable member is insertable through said first and third apertures and slidably engageable with portions of said first and third legs defining said first and third apertures to inhibit disengagement of said first and third container engaging portions from the second different standard sized container.

2. The detachable handle of claim 1 wherein said second leg comprises a plurality of spaced-apart apertures separately alignable with said first aperture so that said detachable handle is separately releasably attachable to a plurality of different standard sized containers.

3. The detachable handle of claim 1 wherein said first aperture comprises a first plurality of spaced-apart apertures, said second aperture comprises a second plurality of spaced-apart apertures, and said first and second plurality of apertures are alignable.

4. The detachable handle of claim 1 wherein said first and second apertures comprise substantially equal cross-sectional configurations.

5. The detachable handle of claim 4 wherein said apertures comprise generally circular-shaped apertures.

6. The detachable handle of claim 1 wherein said first leg is telescopically receivable within said second leg.

7. The detachable handle of claim 1 wherein said handle extends downwardly at an angle from said first member.

8. The detachable handle of claim 1 wherein said handle comprises a knob downwardly depending from the underside of said handle.

9. The detachable handle of claim 1 further comprising an insertable member.

10. The detachable handle of claim 9 wherein said insertable member comprises a screw and a nut attachable to said screw.

11. The detachable handle of claim 1 wherein said detachable handle is attachable to at least one of a quart-sized paint can, a liter-sized paint can, a gallon-sized paint can, a half-pound coffee can, and a one-pound coffee can.

12. The detachable handle of claim 1 wherein said first standard sized container comprises at least one of a pint-sized paint can and a quart-sized paint can, and said second different standard sized container comprises a gallon-sized paint can.

13. A detachable handle for use with a first standard sized container having a first top rim and a first bottom rim and for use with a second different standard sized container having a second top rim and a second bottom rim, said detachable handle comprising:

a first member comprising a handle, a generally vertically extending first leg, and a first container engaging portion, said first leg comprising a first aperture extending generally horizontally through said first leg;

a second member comprising a generally vertically extending second leg and a second container engaging portion, said second leg comprising a second circular-shaped aperture extending generally horizontally through said second leg;

a third member comprising a generally vertically extending third leg and a third container engaging portion, said third leg comprising a third circular-shaped aperture extending generally horizontally through said third leg;

a screw receivable through said apertures and a nut attachable to one end of said screw for releasably attaching said first leg to said second leg, and for releasably attaching said second first leg to said third leg; and wherein when said first and second container engaging portions are engageable with the first top rim and the first bottom rim, respectively, of the first standard sized container, said first aperture is alignable with said second aperture so that said screw is insertable through said first and second apertures and slidably engageable with portions of said first and second legs defining said first and second apertures to inhibit disengagement of said first and second container engaging portions from the first standard sized container; and wherein when said first and third container engaging portions are engageable with the second top rim and the second bottom rim, respectively, of the second different standard sized container, said first aperture is alienable with said third aperture so that said screw is insertable through said first and third apertures and slidably engageable with portions of said first and third legs defining said first and third apertures to inhibit disengagement of said first and third container engaging portions from the second different standard sized container.

14. The detachable handle of claim 13 wherein said second leg comprises a plurality of spaced-apart circular-shaped apertures separately alignable with said first aperture so that said detachable handle is separately releasably attachable to a plurality of different standard sized containers.

15. The detachable handle of claim 13 wherein said first aperture comprises a pair of spaced-apart apertures, said second aperture comprises a pair of spaced-apart apertures, said first pair of spaced-apart apertures are alignable with said second pair of spaced-apart apertures, and said screw and said nut comprises a pair of screws and nuts.

16. The detachable handle of claim 13 is wherein said detachable handle is attachable to at least one of a quart-sized paint can, a liter-sized paint can, a gallon-sized paint can, a half-pound coffee can, and a one-pound coffee can.

* * * * *